United States Patent [19]

Kytir

[11] 4,411,396

[45] Oct. 25, 1983

[54] WINDING MACHINE FOR WINDING STRAND-SHAPED WINDING MATERIAL ON A SPOOL

[76] Inventor: Walter Kytir, Mehlführergasse 28, Vienna A-1238, Austria

[21] Appl. No.: 276,289

[22] Filed: Jun. 22, 1981

[30] Foreign Application Priority Data

Jun. 27, 1980 [DE] Fed. Rep. of Germany ..... 3024093

[51] Int. Cl.[3] ..... B65H 54/28

[52] U.S. Cl. ..... 242/158 R; 242/158.4 R

[58] Field of Search ..... 242/158 R, 158 B, 158 F, 242/158.2, 158.4 R, 25 R, 7.15, 7.16

[56] References Cited

U.S. PATENT DOCUMENTS

| | | | |
|---|---|---|---|
| 3,257,087 | 6/1966 | Kriete et al. | 242/158.4 R |
| 3,815,846 | 6/1974 | Biewer | 242/158 R |
| 3,951,355 | 4/1976 | Morioka et al. | 242/158.4 R X |
| 3,997,128 | 12/1976 | Hara et al. | 242/158.4 R |
| 4,150,801 | 4/1979 | Ikegami et al. | 242/158 R |
| 4,235,394 | 11/1980 | Fry | 242/158.4 R X |
| 4,283,020 | 8/1981 | Bauer et al. | 242/158.4 R X |

*Primary Examiner*—Stanley N. Gilreath

*Attorney, Agent, or Firm*—Martin A. Farber

[57] ABSTRACT

A winding machine which can move back and forth on guide rails for winding strand-shaped winding material includes a frame and a spool, the spool being rotatably mounted on a vertical spindle sleeve arm. A spool speed detection meter for detecting the speed of rotation of the spool and a measuring device for detecting the arrival speed of the winding material are provided on a stationary strand guide. A computer compares the speed of rotation of the spool and the arrival speed of the winding material, and upon a sudden change in the ratio of both these measured variables effects a reverse movement of the feed drive which moves the winding machine.

3 Claims, 3 Drawing Figures

Fig.1
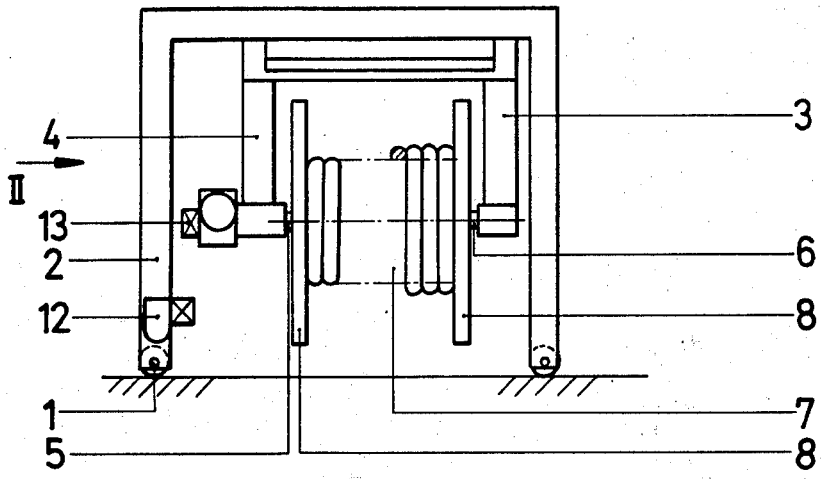
Fig. 2
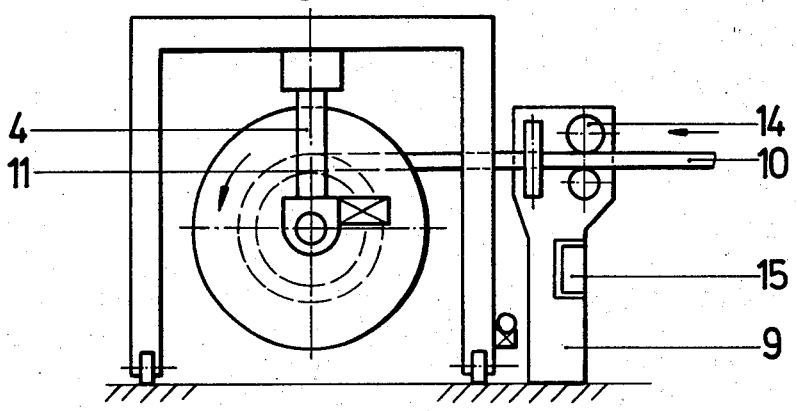
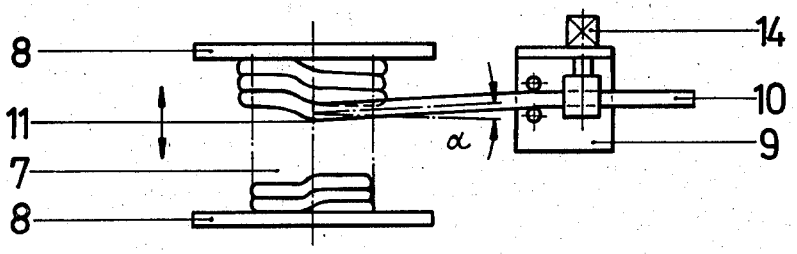
Fig.3

WINDING MACHINE FOR WINDING STRAND-SHAPED WINDING MATERIAL ON A SPOOL

The present invention relates to a winding machine for winding strand-shaped winding material onto a spool to which the winding material is fed via a strand guide (the guide for the material to be wound), the machine having a laying drive for the reciprocating traversing movement of spool and strand guide along one another, the laying drive being controlled upon the rising of the winding material at a spool flange in accordance with a pre-established program during the transition to the next higher winding layer.

If the run-on point of the winding material has reached a spool flange on such winding machines during the development of a winding layer, a number of special laying movements must be carried out in order to obtain a good winding package and a precise filling out of the remaining gusset space so that a uniform transition into the next winding layer is obtained. Ordinarily the winding material is fed with a hold-back angle between the two spool flanges in order to assure tight application of the turns. The laying movements are carried out in the known winding machine either by axial traverse of the spool or by traverse of the strand guide parallel to the axis of the spool. One program of laying movements which is commonly carried out (West German Pat. No. 15 74 425) upon arrival of the run-on point of the winding material at a spool flange consists of:

(1) parallel pulling of the winding material to the flange for a given spool rotation until the building up of the first turn of the next winding layer, (2) pulling the winding material away from the flange in order to prevent a climbing of the turns on the flange into the second layer above, (3) after a given further rotation of the bobbin, swinging back the winding material in order to set the desired hold-back angle for the winding in the next winding layer.

For proper laying, it is of decisive importance to be able reliably to note the arrival of the run-on point at a flange or the rising of a new winding layer at the flange so that the program to be then carried out is started always at exactly the correct time.

From West German Pat. No. 15 74 425 and 19 02 722, winding machines with traversing drive for the spool are known in which limit switches for detecting the end positions, dependent on the length of spool, are arranged on the frame of the winding machine, which switches control the course of the laying movements upon transition to the next winding layer, in combination with other limit switches which are controlled as a function of the arrival angle of the winding material. The detection there and control of the laying drive upon transition into the next winding layer is , however, expensive from a structural standpoint and requires precise mechanical adjustments. From U.S. Pat. No. 3,951,355 it is known to detect the rise of a new winding layer by means of approach switches which operate without contact. However, they must be raised from winding layer to winding layer by separate stepping motors, as a result of which the arrangement in that patent is relatively expensive and susceptible to disturbance. West German OS No. 25 56 484 also discloses a cable winding machine in which the rise into a new winding layer is detected by larger sensors which have a swing arm which lies, via a slide shoe, against the winding and can be lifted off from it against spring pressure, an electric signal being given off upon the swinging up of the arms. Such layer sensors with feeler or slide members acting directly on the winding material are, however, frequently unsuitable, are themselves subject to wear, and may injure more sensitive winding material.

The object of the present invention is to equip winding machines of the above type with means for detecting the rise of the windings into a winding layer, which are of very low price and completely free of disturbance and wear.

This problem is solved in accordance with the invention by a reversing device which determines the ratio of the spool speed of rotation to the winding-material arrival speed and, upon change in the ratio of spool speed to arrival speed, turns on the control program for transition into the next winding layer. In accordance with the invention, the reversing device can in this connection be of very simple construction and may comprise merely a spool speed of rotation meter, a measuring device which determines the speed of arrival of the winding material and a programmable computer which immediately indicates a change in the ratio monitored.

In ordinary winding machines, at the end of cable manufacturing systems the arrival speed remains constant while the speed of rotation of the spool is suitably decreased from winding layer to winding layer via a reduction gearing or a torque monitoring device. In the case of rewinders, however, the receiving spool can be driven with a continuously constant speed of rotation, in which case the arrival speed of the winding material increases from winding layer to winding layer. In both cases, as well as when the speed of rotation and arrival speed are variable, the transition to a new winding layer is in each case reliably and rapidly detected by the reversal device of the invention so that the reversal program for the laying drive is initiated and carried out under, in each case, recurrent constant conditions. Since the possibility is available by means of suitable computer programs to filter out different disturbing influences such as, for instance, the recurring variations in diameter of the winding material, very good results for the detection of the flange and the rise into the next layer can be obtained with the reversal method of the invention. The limits of the method employed here reside in the ratio of the smallest winding-material diameter to the diameter and in the inaccuracies of the spool. Practical tests have given excellent results down to a diameter of the winding material of 8 to 10 mm.

The invention will be explained in further detail below with reference to an illustrative embodiment shown in the drawing, in which:

FIG. 1 is a front view of a winding machine in accordance with the invention;

FIG. 2 is a side view of the winding machine of FIG. 1 seen in the direction of the arrow II; and FIG. 3 is a partial top view of the winding machine of FIG. 2.

FIGS. 1 and 2 show a winding machine having a four-leg frame 2 which is movable on rollers 1 and from the upper part of which there are suspended two spindle sleeve arms 3, 4, a spool 7 having flanges 8 being received on the lower spindle sleeves 5, 6. By means of a strand guide 9 which is arranged in fixed position, the spool 7 is fed a strand-shaped (cord-, cable-shaped or the like) winding material 10 which is to be fed with closely adjacent turns and winding layers arranged precisely above one another. During the winding process, the winding-material run-on point 11 travels back and forth between the spool flange 8; in order to obtain a close application of adjacent windings, the winding material should travel onto the spool with a constant run-on angle $\alpha$. In order to preserve the angle $\alpha$, the winder in the case of the embodiment shown by way of example is moved back and forth on ground rails in front of the strand guide 9 by means of a feed drive 12.

When the winding-material run-on point 11 reaches a flange 8, the next winding rises into the next higher winding layer whose winding diameter is greater than previously by twice the diameter of the winding material. In this way the ratio between the spool speed of rotation and the winding-material arrival speed changes suddenly. The winding machine is provided with a spool speed-of-rotation meter 13 and with a measuring device 14 which detects the speed of arrival of the winding material. The measurement values of these devices 13 and 14 are supplied to a programmable computer 15 which monitors the ratio of the two speed values and in case of a change turns on the transition control program for the feed drive 12.

While I have disclosed one embodiment of my invention, it is to be understood that this embodiment is given by example only and not in a limiting sense.

I claim:

1. In a winding machine for winding strand-shaped winding material on a rotating spool to which the winding material is fed via a strand guide, having a feed drive for effecting a relatively reciprocating traversing movement between the spool and the strand guide axially of the spool, the feed drive being controlled upon the rising of the winding material at a spool flange in accordance with a pre-established control program during the transition into a next higher winding layer, the improvement comprising a reversing means for reversing the relative movement between the spool and the strand guide, said reversing means including means for detecting a ratio of the speed of rotation of the spool with respect to speed of arrival of the winding material at the spool and means for reacting to a change in the ratio of the speed of rotation of the spool with respect to the speed of arrival of the winding material including the control program for causing the feed drive to change the relative direction of movement between the spool and the strand guide.

2. The winding machine according to claim 1, wherein said ratio detecting means comprises, a rotation meter means for detecting the speed of rotation of the spool, measuring means for detecting the speed of arrival of the winding material, and a programmable computer means connected to said rotation meter means to said measuring means for determining said change in the ratio and based thereon monitoring the relative direction of movement between the spool and the strand guide via the control program.

3. In a winding machine for winding strand-shaped winding material from a stationary strand guide onto a spool which is arranged on a frame, which frame being traversable axially of the spool and by means of a feed drive is movable back and forth in the axial direction of the spool for a reciprocating winding movement, the improvement comprising a spool speed detector meter supported on the frame for detecting the speed of rotation of the spool, a measuring means on the stationary strand guide for detecting the arrival speed of the winding material, computer means operatively connected with the spool speed detector meter and with the measuring means for monitoring the ratio of the arrival speed of the winding material with respect to the speed of rotation of the spool and for causing reverse movement of the feed drive to reverse the direction of movement of the winding machine upon a sudden change in the ratio of the arrival speed of the winding material with respect to the speed of rotation of the spool.

* * * * *